US010053857B1

(12) United States Patent
Gebhardt

(10) Patent No.: US 10,053,857 B1
(45) Date of Patent: Aug. 21, 2018

(54) EXPANSION JOINT COVER PLATE WITH RETAINED SPRING BIASING

(71) Applicant: InPro Corporation, Muskego, WI (US)

(72) Inventor: David R. Gebhardt, Shorewood, WI (US)

(73) Assignee: InPro Corporation, Muskego, WI (US)

( * ) Notice: Subject to any disclaimer, the term of this patent is extended or adjusted under 35 U.S.C. 154(b) by 0 days.

(21) Appl. No.: 15/794,780

(22) Filed: Oct. 26, 2017

(51) Int. Cl.
*E04B 1/68* (2006.01)

(52) U.S. Cl.
CPC ..... *E04B 1/6803* (2013.01)

(58) Field of Classification Search
CPC ..... E04B 1/6803
USPC ..... 52/393–395, 306.04
See application file for complete search history.

(56) References Cited

U.S. PATENT DOCUMENTS 3,394,639 A * 7/1968 Viehmann ..... E01C 11/126 404/47
3,435,574 A * 4/1969 Hallock ..... E04B 1/6803 404/69
3,745,726 A * 7/1973 Thom ..... E04B 1/6804 404/47
3,779,660 A * 12/1973 McGeary ..... E04B 1/6804 404/69
4,442,647 A * 4/1984 Olsen ..... B64C 1/40 244/119
5,078,529 A * 1/1992 Moulton ..... E04B 1/6804 403/24
5,799,456 A * 9/1998 Shreiner ..... E04B 1/6803 52/396.04
8,887,463 B2 * 11/2014 Derrigan ..... E02D 17/10 404/25

* cited by examiner

*Primary Examiner* — Beth A Stephan
(74) *Attorney, Agent, or Firm* — Reinhart Boerner Van Deuren S.C.

(57) ABSTRACT

An expansion joint cover plate assembly for covering a gap between first and second sections of a building formation such as wall, floor or ceiling of a building. The assembly includes a cover plate, a support structure for supporting the plate relative to the building formation and a spring biasing structure for holding the plate against the support structure.

19 Claims, 10 Drawing Sheets

EXPANSION JOINT COVER PLATE WITH RETAINED SPRING BIASING

BACKGROUND OF THE INVENTION

The present invention relates generally to the field of expansion joints for building structures such as, e.g. floors, ceilings and walls. The present invention relates more specifically to a joint cover which is biased against the structure surfaces adjacent to an expansion gap within the respective floor, ceiling or wall. The biasing force is preferably generated by a spring assembly including a spring retained by a spring retainer which provides for adjustability of the spring force, as well as simplified assembly and removal with respective to the other components forming the expansion joint assembly.

SUMMARY OF THE INVENTION

One embodiment of the invention relates to an expansion joint cover plate assembly used for covering a gap between first and second sections of a wall, floor or ceiling of a building. The assembly includes a first support plate attachable to a first section. The first support plate has a first support surface and a first engagement surface opposed to the first support surface. A second support plate is attachable to a second section and the second support plate has a second support surface and a second engagement surface opposed to the second support surface. The assembly includes a cover plate extending between and supportable by the first and second support surfaces. The assembly includes at least one centering bar, which defines a rod opening and which has a first end engageable with the first engagement surface and a second end engageable with the second engagement surface. The assembly includes an end assembly defining a first center opening, the end assembly including at least two translation rods each joined to the end assembly at one end and having a one-way catch at the opposite end. The assembly includes a spring plunger defining a second center opening, the plunger including a first catch opening on one side of the second center opening and a second catch opening on the opposite side of the second center opening. The assembly includes a spring compressed between the end assembly and the spring plunger such that an end portion of each translation rod is located within a respective catch opening, and the one-way catches engage respective catch openings such that the spring retains a minimum compression between the end assembly and spring plunger. The spring is further compressible when the translation rods move within the catch openings to permit a reduction in the distance between the end assembly and the spring plunger. The assembly includes a pull rod which is engageable with the cover plate and the spring plunger to extend through the rod opening, the first center opening, the spring, and the second center opening such that the spring biases the cover plate against the first and second support surfaces and biases the first and second ends of the centering bar against the respective first and second engagement surfaces.

Another embodiment of the invention relates to an expansion joint cover plate assembly that covers a gap between first and second sections of a building floor. The assembly includes a first support plate attached to the first section of the floor, the first support plate having a first support surface and a first engagement surface opposed to the first support surface. The assembly includes a second support plate attached to the second section of the floor, the second support plate having a second support surface and a second engagement surface opposed to the second support surface. The assembly also includes at least one centering bar which defines a rod opening and has a first end slidably engaged with the first engagement surface and a second end slidably engaged with the second engagement surface. A cover plate extends between and is slidably supported by the first and second support surfaces. The assembly also includes an end assembly defining a first center opening, the end assembly including at least two translation rods, each joined to the end assembly at one end and having a one-way catch at the opposite end. The assembly includes a spring plunger defining a second center opening, the plunger including a first catch opening on one side of the second center opening and a second catch opening on the opposite side of the second center opening. The assembly includes a spring compressed between the end assembly and the spring plunger such that an end portion of each translation rod is located within a respective catch opening, and the one-way catches engage respective catch openings such that the spring is compressed between the end assembly and spring plunger with the spring further compressible when the translation rods move within the catch openings to permit a reduction in the distance between the end assembly and the spring plunger. The assembly includes a pull rod attached to the cover plate, which engages the spring plunger and extends through the rod opening, the first center opening, the spring, and the second center opening such that the spring is compressed to bias the cover plate against the first and second support surfaces and biases the first and second ends of the centering bar against the respective first and second engagement surfaces.

Another embodiment of the invention relates to an expansion joint cover plate assembly for covering a gap between first and second sections of a wall, floor or ceiling of a building. The assembly includes a first support plate which is attachable to a first section, the first support plate having a first support surface and a first engagement surface opposed to the first support surface. The assembly includes a second support plate which is attachable to a second section, the second support plate having a second support surface and a second engagement surface opposed to the second support surface. The assembly includes a third support plate attachable to the first section proximate to the first plate support, the third support plate having a third support surface. The assembly also includes a fourth support plate which is attachable to the second section proximate to the second plate support. The fourth support plate has a fourth support surface. The assembly includes a cover plate extending between and supportable by the first and second support surfaces, a first wing plate attachable to and supportable by the first and third support surfaces, a second wing plate attachable to and supportable by the second and fourth support surfaces, and a cover plate extendable between and supportable by the first and second wing plates. The assembly includes at least one centering bar which defines a rod opening and has a first end engageable with the first engagement surface and a second end engageable with the second engagement surface. The assembly also includes a spring, a pull rod fixed at a first end to the cover plate and extendable from the cover plate through the rod opening and through the spring, an end assembly engageable to a second end of the rod to compress the spring between the end assembly and the centering bar such that the cover plate is forced against and held in contact with the wing plates.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1A:
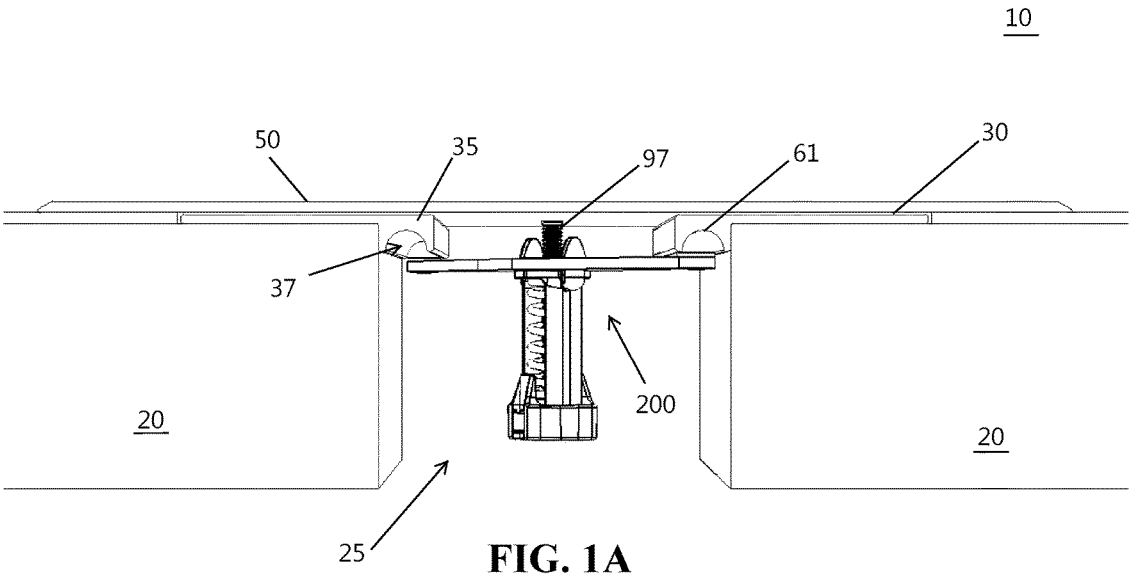
FIG. 1A is a sectional side view of an expansion joint assembly for covering a joint space between first and second sections of a wall, floor or ceiling of a building according to one embodiment.
Figure 1B:
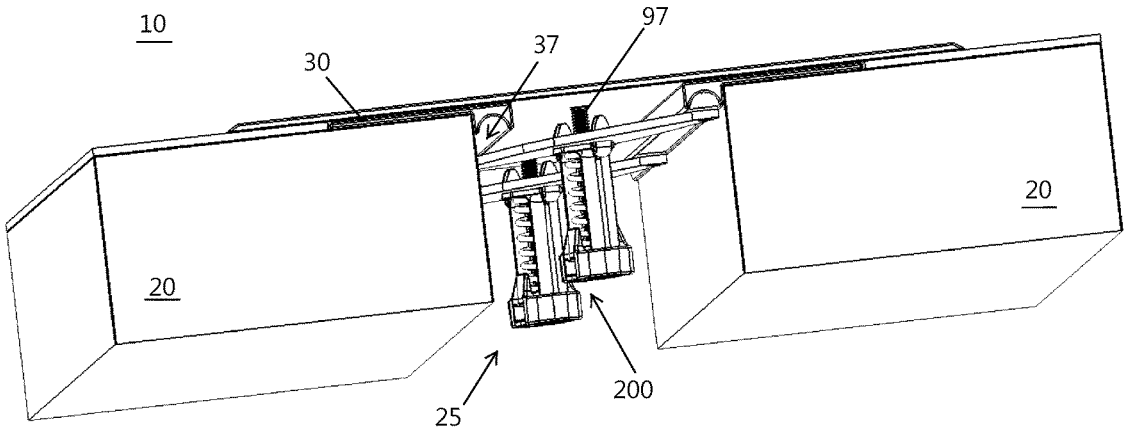
FIG. 1B is a bottom perspective view to the expansion joint assembly of FIG. 1A.
Figure 1C:
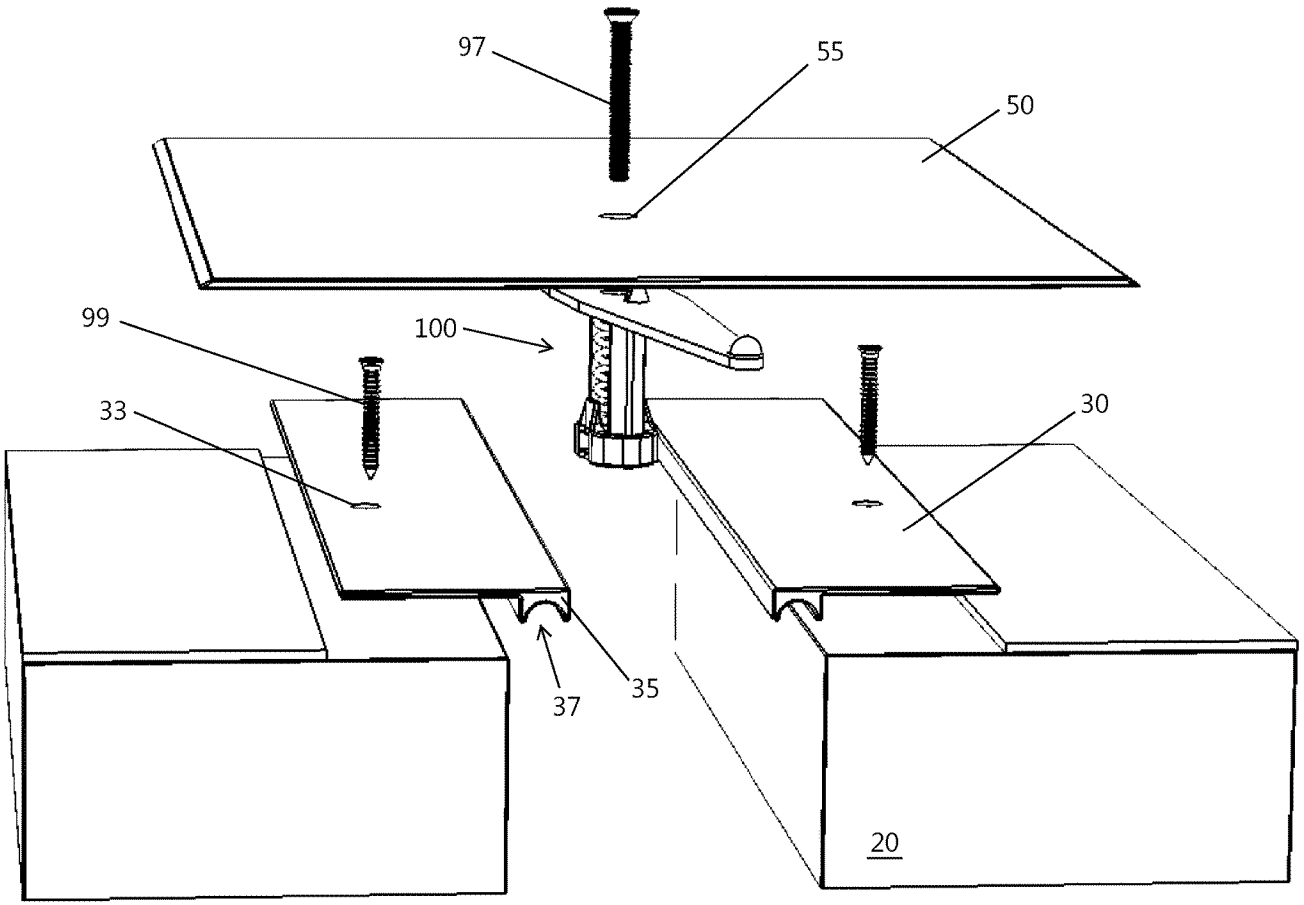
FIG. 1C is an exploded view of the individual components of the expansion joint assembly of FIG. 1A.

Referring to FIGS. 1A-1C, one embodiment of an expansion joint assembly 10 for covering a joint space 25 extending between adjacent structures 20 of a building formation, such as e.g. a wall, a floor, a ceiling, etc. is illustrated. As will be described in more detail below, expansion joint assembly 10 generally comprises one or more frames, such as support plates 30, configured to be anchored along the portions of the structure 20 bordering the joint space 25 the expansion joint assembly 10 is configured to cover. The support plates 30 are configured to engage a centering assembly 200 that is configured to resiliently maintain an elongated cover plate 50 in place over and across the joint space 25 such that the cover plate 50 spans and covers the entirety of the joint space 20 even as the adjacent structures 20 defining the joint space 25 move toward or away from another, such as, e.g. may occur during earthquakes, or as a result from day-to-day thermal changes.

Figure 2:
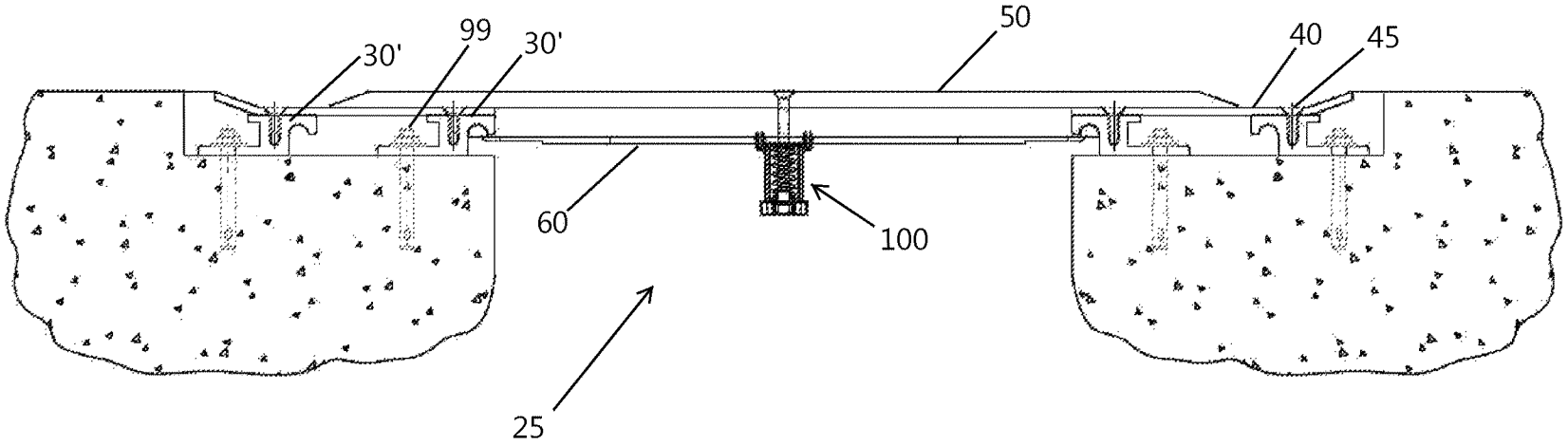
FIG. 2 is sectional side view of an expansion joint assembly for covering a joint space between first and second sections of a wall, floor or ceiling of a building according to one embodiment.

As illustrated by the expansion joint assembly 10 embodiment of FIG. 2, in some embodiments, wing plates 40 may optionally be included as part of the expansion joint assembly 10. As shown in FIG. 2, in some embodiments, the portion of the structure 20 to which the expansion joint assembly 10 is attached may be differently sized or otherwise varied in configuration relative to adjacent portions of the structure 20. As a result, in some circumstances the upper surfaces of the support plates 40 may not being coextensive and/or coplanar with the exterior surfaces of those portions of the structure 20 surrounding the area to which the expansion joint assembly 10 is anchored. When the expansion joint assembly 10 is used under such circumstances, one or more wing plates 40 attached along the upper surfaces of the support plates 30 and below the cover 50 may provide a smoother transition between the exterior portions of the structures 20 surrounding the expansion joint assembly 10 and the cover plate 50.

In some embodiments, wing plates 40 may be fabricated from steel sheet material, similar to cover plate 50. Where fluid flow through the wing plates 40 is required, wing plates 40 may optionally be fabricated from appropriate expanded metal. Wing plates 40 may be attached to the upper surfaces of support plates 30 using any number or any combination of fasteners or attachments, such as, e.g. adhesive, or, as illustrated in the embodiment of FIG. 2, bolts 45 extending through corresponding opening formed through the wing plates 40.

Referring to FIG. 1C, in some embodiments support plates 30 may be formed as elongated rail-type members configured to extend along the length of, or along a substantial length of, the exterior portions of the adjacent structures 20 that border and define the expansion joint 25. Alternatively, in other embodiments, support plates 30 may be formed from a series of discrete sectional pieces having any desired length, which are subsequently arranged and installed to extend continuously or interruptedly (i.e. spaced apart) along the exterior surfaces of the edges of the adjacent structures 20 defining joint space 25.

Support plates 30 may be defined by any number of configurations, shapes, sizes, etc. In some embodiments, each of the support plates 30 of the expansion joint assembly 10 may be defined by the same configuration, shape, size, etc. In other embodiments, the support plates 30 used in the expansion joint assembly 10 may comprise any number of support plates 30 formed having any number of different configurations, shapes, sizes, etc. The number, type, configuration, arrangement, etc. of the support plates 30 may depend on the type and degree of expansion, contraction, and/or other movement that the structures 20 are expected to undergo. The number, type, configuration, arrangement etc. of the support plates 30 may also be influenced by the particular surface characteristics of the structure 20 to which the support plates 30 will be attached.

As illustrated in FIGS. 1A-1C, in one embodiment support plates 30 may be defined by substantially flat, planar main body portion. Extending along the length of an edge of the bottom surface of the planar main body portion is a rail structure 35. As shown in FIGS. 1A-1C, formed along the length of the bottom surface of the rail structure 35 is a generally u-shaped, or semi-cylindrical channel 37.

In some embodiments, support plates 30 may be anchored to the structures 20 via one or more fastener assemblies, such as, e.g. bolts 99 that are configured to extend through openings 33 extending through the support plates 30. Alternatively, or additionally, support plates 30 may be attached to the structure 20 using any other number of attachments, such as, e.g. masonry adhesive having an affinity for the material from which the support plates 30 are fabricated.

Illustrated in FIG. 2 is another embodiment of support plates 30 that may be used in the expansion joint assembly 10. As shown in FIG. 2, in one embodiment support plates 30 may be defined by a modified L-shaped cross-section as shown which includes bottom base section configured to be mounted to the exterior surface of a structure 20, and an upwardly extending post section having a hook formation defining a channel 37 at an upper portion. Further referring to FIG. 2, in some embodiments, more than one support plate 30 may be arranged on one or both of the structures 20 defining joint space 25. In such embodiments, the two or more support plates 30 attached to the same structure 20 may each have the same support plate 30 shape, configuration, dimensions, etc. Alternatively, the two or more support plates 30 may include any number of, and any combination of support plate 30 shapes, configurations, dimensions, etc.

Support plates 30 may be formed from any number of materials or combination of materials having a compressive strength adequate to provide the required support for the expansion joint assembly 10. In some embodiments the support plates 30 are formed from extruded aluminum. In other embodiments, the support plates 30 may be formed from an extruded or molded thermoplastic or thermoset material.

Figure 3A:
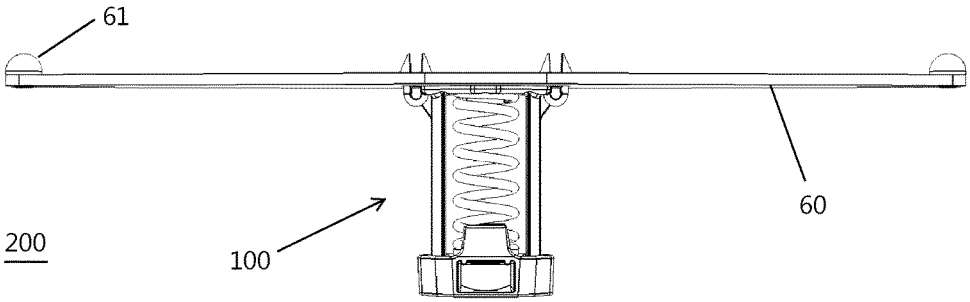
FIG. 3A is a side view of a centering assembly according to one embodiment.
Figure 3B:
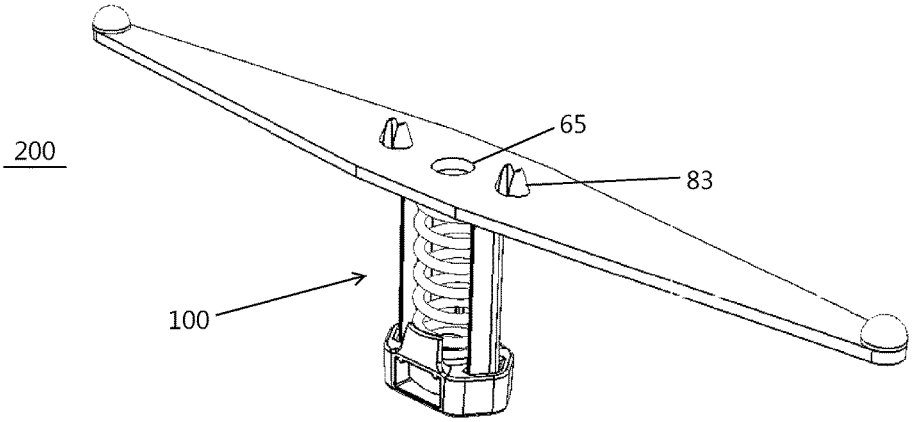
FIG. 3B is a top perspective view of the centering assembly of FIG. 3A.

As shown in FIGS. 1A-C and FIG. 2, also included as part of the expansion joint assembly 10 are one or more centering assemblies 200. Turning to FIGS. 3A and 3B, each centering assembly 200 comprises a centering bar 60 that is attached to a spring clip housing 100. As noted above, when attached to the cover plate 50, the centering assembly 200 is configured to maintain the cover plate 50 in a centered or symmetrical position relative to the structures 20 during movement of the structures 20.

As illustrated in FIGS. 1A, 1B and 2, centering bars 60 of the centering assemblies 200 are pivotally connected to the cover plate 50 at various points along the length of the expansion joint assembly 10. In various embodiments, the spacing of centering bars 60 within the joint space 25 may be any desired distance, and in some embodiment may be between approximately 6 and 24 inches. The arrangement of guide elements 61 that extend upwards from the ends of the centering bars 60 within the channels 37 of support plates 30 allows the centering bars 60 to pivot about their center points (which are attached to the cover plate 50 via a pull rod 97 attached to the centering assembly 200), as the structures 20 move toward and away from each other causing the joint space 25 to expand or contract. The pivoting of the centering bars 60 about the pull rod 97 extending through the centering assembly 200 results in the cover plate 50 being held in a symmetrical, centered position relative to the movable structures 20, allowing the cover plate 50 to be centered relative to the structures 20 during expansion or contractions of the joint space 25.

Figure 4:
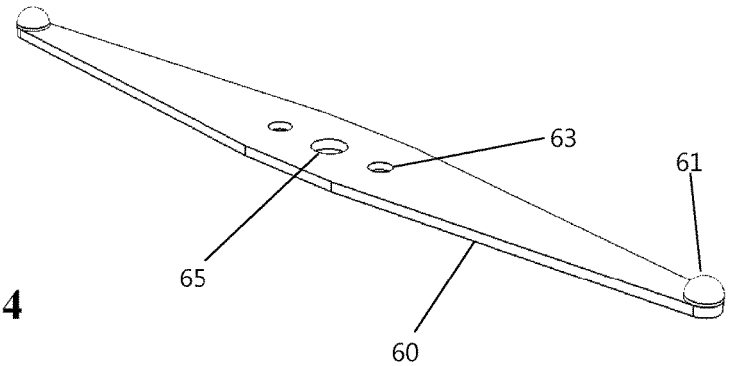
FIG. 4 is a top perspective view of a centering bar according to one embodiment.

Referring to FIG. 4, each centering bar 60 includes a rod opening 65 which is preferably centered between the ends of the centering bar 60. Also extending in between ends of the centering bar 60 are one or more spring retainer engagement structures, such as, e.g. openings 63 extending through the centering bar 60 on either side of the rod opening 65 as shown in the centering bar 60 embodiment of FIG. 4. As will be described in more detail below, the spring retainer engagement structures, such as, e.g. openings 63, are configured to engage with a corresponding structure(s) on the spring retainer 80 when the centering assembly 200 is assembled.

Attached at each end of the centering bar 60 is a guide element, 61 such as, e.g. a bearing grommet, rounded pin, or other structure that is sized and configured to slidably engage with the channels 37 of the support plates 30 of the expansion joint assembly 10, and which transmit force from the ends of the centering bar 60 to the channels 37 of the support plates 30. Guide elements 61 may be fabricated from a metal, plastic, or other suitable material. In some embodiments, the guide elements may be formed integrally or monolithically formed with the ends of the centering bar 60. In other embodiments, guide elements 61 may be attached to the centering bar 60 using any number of known attachment arrangements.

Figure 5B:
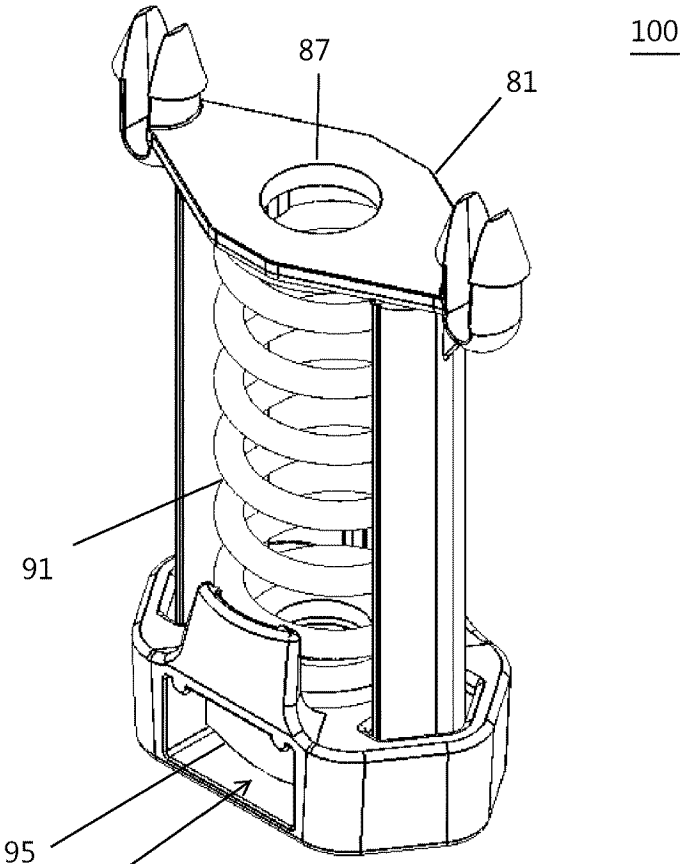
FIG. 5B is a top perspective view of the spring clip housing of FIG. 5A.
Figure 5A:
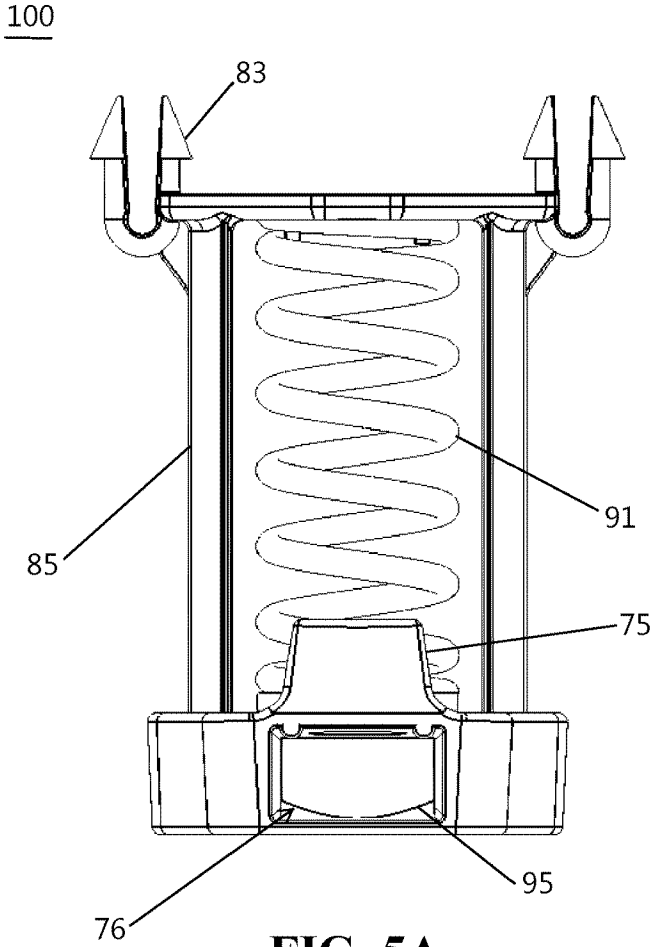
FIG. 5A is a side view of a spring clip housing according to one embodiment.
Figure 5C:
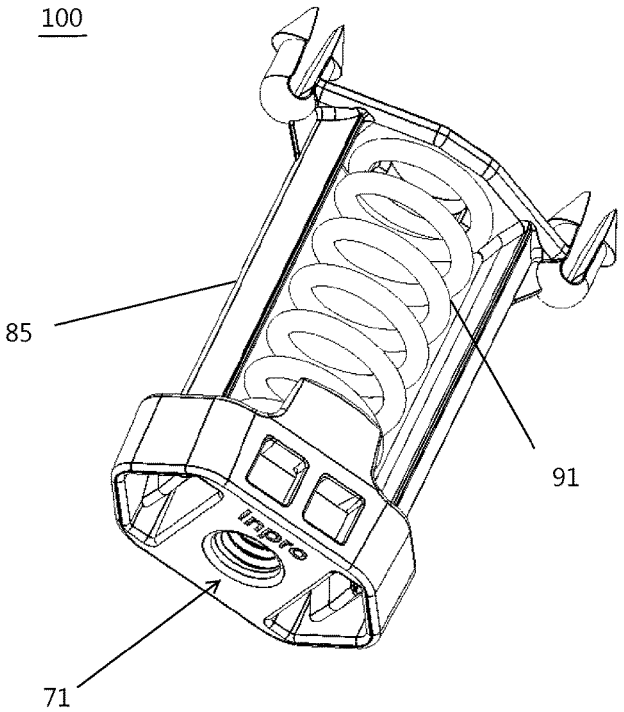
FIG. 5C is a bottom perspective view of the spring clip housing of FIG. 5A.

Referring to FIGS. 5A-5C, one embodiment of a spring clip housing 100 configured to attach to a centering bar 60 to form centering assembly 200 is illustrated. In particular, the embodiment of the spring clip housing 100 shown in FIGS. 5A-5C is configured to be attached to a centering bar 60 such as, e.g. the centering bar 60 embodiment illustrated FIG. 4. In general, spring clip housing 100 includes a spring 91, a plunger 70 and a spring retainer 80.

Figure 6A:
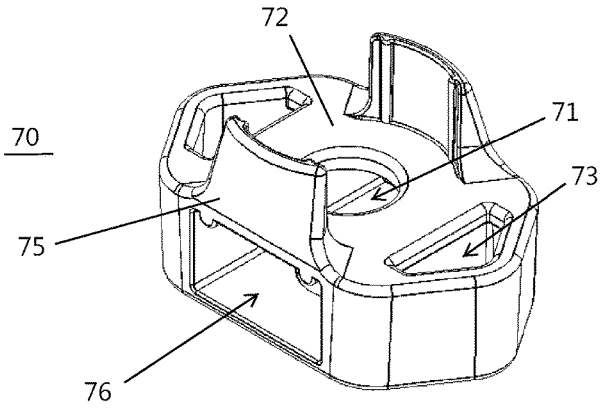
FIG. 6A is a top perspective view of a plunger according to one embodiment.
Figure 6B:
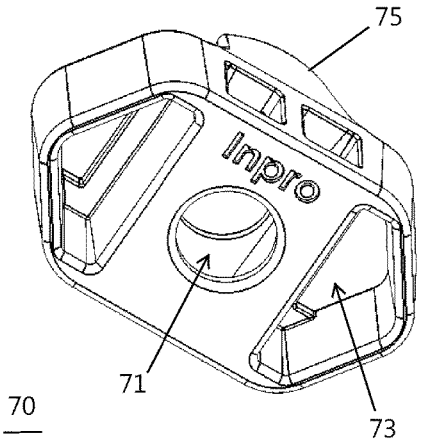
FIG. 6B is a bottom perspective view of the plunger of FIG. 6A.

Turning to FIGS. 6A and 6B, the spring plunger 70 includes a bearing surface 72, which defines an opening 71 through which a pull rod 97 (see, e.g. FIG. 1A) is configured to pass. In some embodiments, the bearing surface 72 may interface directly with spring 91 when the spring clip housing 100 is assembled. In other embodiments, such as e.g. illustrated in the spring clip housing 100 embodiment of FIGS. 5A-5C, a washer 93 may optionally be positioned between the spring 91 and the bearing surface 72.

Located below the bearing surface 72 is a nut pocket 76 which partially encloses a threaded nut 95. Pocket 76 is configured to hold nut 95 and prevent rotation of nut 95 when nut 95 is engaged with a threaded end of the pull rod 97 while the pull rod 97 is rotated to vary the compression force in spring 91 (discussed in further detail below). Catch openings 73 are formed in the plunger 70 on each side of opening 71. Also optionally provided on plunger 70 are one or more retention tabs 75 configured to assist in aligning and keeping the spring 90 aligned within the spring clip housing 100.

As shown in the embodiment of plunger 70 illustrated in FIGS. 6A and 6B, in some embodiments the retention tabs 75 may be arranged on plunger 70 so as to extend radially outwards relative to the spring 91 once the spring clip housing 100 is assembled. However, in other embodiments (not shown) one or more retention tab 75, such as e.g. a cylindrical post extending about opening 71, may be arranged on plunger 70 so as to extend radially inwards relative to the spring 91 once the spring clip housing 100 is assembled.

Figure 7A:
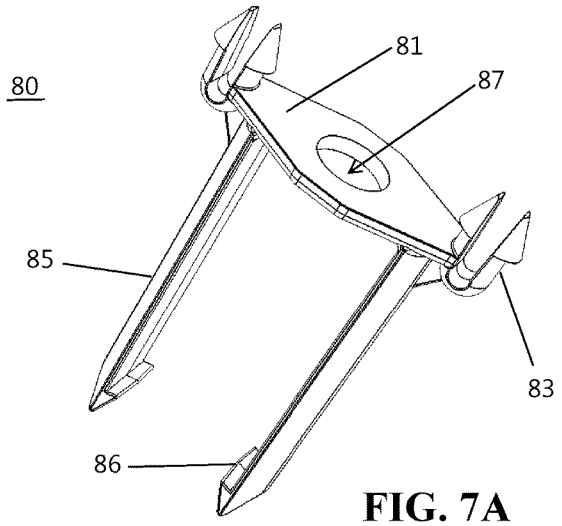
FIG. 7A is a top perspective view of a spring retainer according to one embodiment.
Figure 7B:
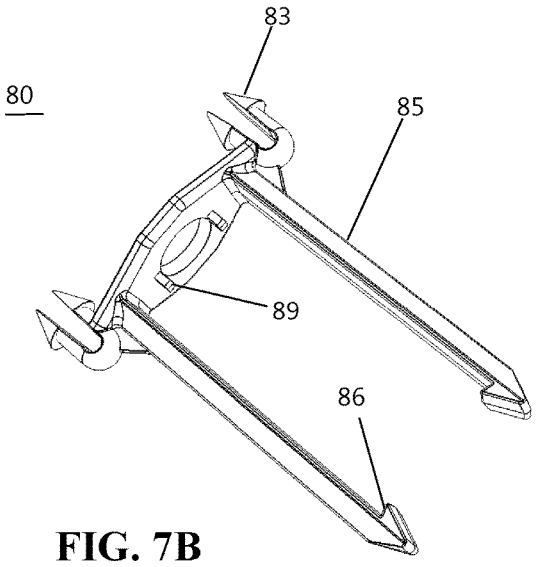
FIG. 7B is a bottom perspective view of the spring retainer of FIG. 7A.

Turning to FIGS. 7A and 7B, one embodiment of a spring retainer 80 is illustrated. Spring retainer 80 includes a top plate 81 having an opening 87 through which pull rod 97 passes. Extending upwards relative to the top plate 81 are one or more centering bar engagement elements, such as, e.g. the barbed hooks 83 of the spring retainer 80 embodiment shown in FIGS. 7A and 7B. Centering bar engagement elements, such as, e.g. barbed hooks 83 may be configured to securely and fixedly engage corresponding one or more spring retainer engagement structures formed on the centering bar 60 to assemble centering assembly 200.

In some embodiments, the attachment of the centering bar engagement elements of the spring retainer 80 and the spring retainer engagement structures formed on the centering bar 60 may be configured to provide for a permanent attachment of the spring retainer 80 and centering bar 60. Alternatively, in other embodiments, such as, e.g. illustrated by the spring retainer 80 embodiment of FIGS. 7A and 7B and the centering bar 60 embodiment of FIG. 4, the attachment of the centering bar engagement elements of the spring retainer 80, i.e. the barbed hooks 83, and the spring retainer engagement structures formed on the centering bar 60, i.e. openings 63, may be configured to allow for detachment of the spring retainer 80 from the centering bar 60 if required (e.g. for maintenance and/or part replacement purposes).

Figure 8:
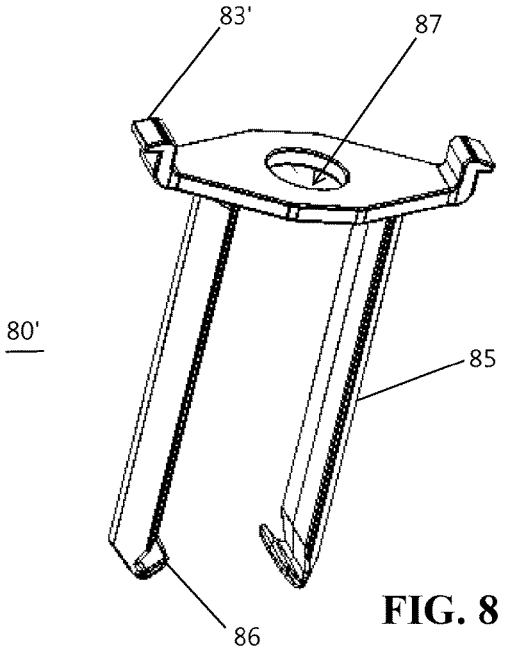
FIG. 8 is a top perspective view of a spring retainer according to one embodiment.

It is to be understood that in other embodiments, the centering bar engagement element(s) of the spring retainer 80 and the corresponding spring retainer engagement structure(s) of the centering bar 60 may comprise any number of configurations that would provide for a securely fixed attachment between the centering bar 60 and the spring retainer 80, including, but not limited to attachment arms formed on the centering bar 60 and/or spring retainer 80, tabs formed on the centering bar 60 or spring retainer 80 configured to wrap around the sides of the other of the spring retainer 80 or centering bar 60; tabs that are configured to co-engage an engagement structure, snap engaging elements, adhesive, etc. One embodiment of such an alternate configuration of the centering bar engagement elements that may be provided on the spring retainer 80 is illustrated in FIG. 8. Further referring to FIGS. 7A and 7B, extending downwards relative to the top plate 81 are one or more translation rods, such as arms 85. Formed at the lower end of each arm 85 is an inwardly extending catch 86. When the spring clip housing 100 is assembly, the catch 83 is configured to prevent unintentional disengagement of the plunger 70 and the spring retainer 80 which could otherwise occur if the pull rod 97 were sufficiently loosened. Optionally extending downwards relative to the top plate 81 may be one or more spring centering elements 89 configured to maintain the opening of the spring 91 aligned with the opening 87 extending through the top plate 81.

Figure 9A:
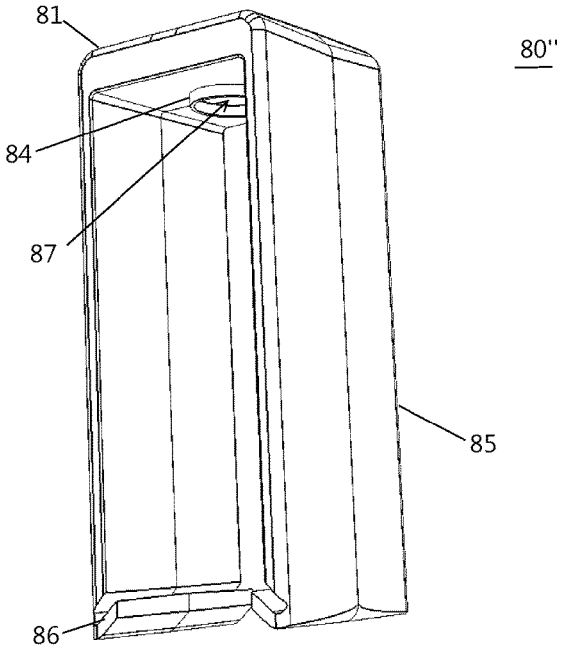
FIG. 9A is a bottom perspective view of a spring retainer according to one embodiment.
Figure 9B:
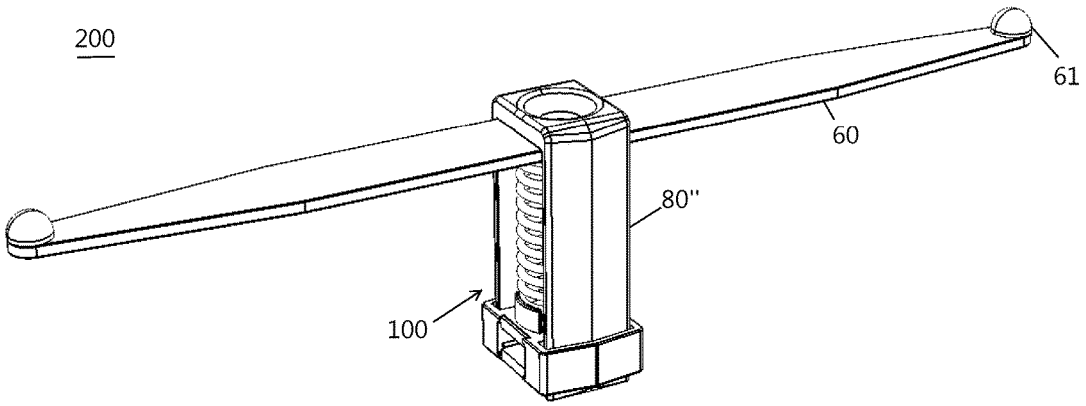
FIG. 9B is a top perspective view of a centering assembly incorporating the spring retainer embodiment of FIG. 9A according to one embodiment.

Illustrated in FIGS. 9A and 9B is yet another alternative embodiment of a spring retainer 80" and a centering assembly 200 having a spring clip housing 100 that incorporates such a spring retainer 80". As shown in FIG. 9B, the spring retainer 80" is configured such that the top plate 81 of the spring retainer 80" is positioned atop the upper surface of the centering bar 60 and the arms 85 wrap around the front and rear edges of the centering bar 60.

As shown in FIG. 9A, in some embodiments, the spring retainer 80" may include one or more posts 84 extending downwardly from the lower surface of the top plate 81 about the opening 87. Similar to the spring centering elements 89 of the spring retainer 80 embodiment of FIGS. 7A and 7B, the post(s) 84 may be configured to maintain the opening of the spring 91 aligned with the opening 87 in top plate 81. Additionally, the post(s) 84 are also sized to fit through the rod opening 65 of centering bar 60 so as to keep the spring retainer 80"/spring clip housing 100 aligned with and attached to the centering bar 60. Alternatively, or additionally, the embodiment of spring retainer 80" of FIGS. 9A and 9B may include a countersink (not shown) defined in the lower surface of the top plate 81, with the countersink being sized and shaped to conform to the outer periphery of the centering bar 60 so as to provide a close fit and interaction with the centering bar 60, so as to maintain the spring retainer 80"/spring clip housing 100 aligned and secured to the centering bar 60.

Figure 10:
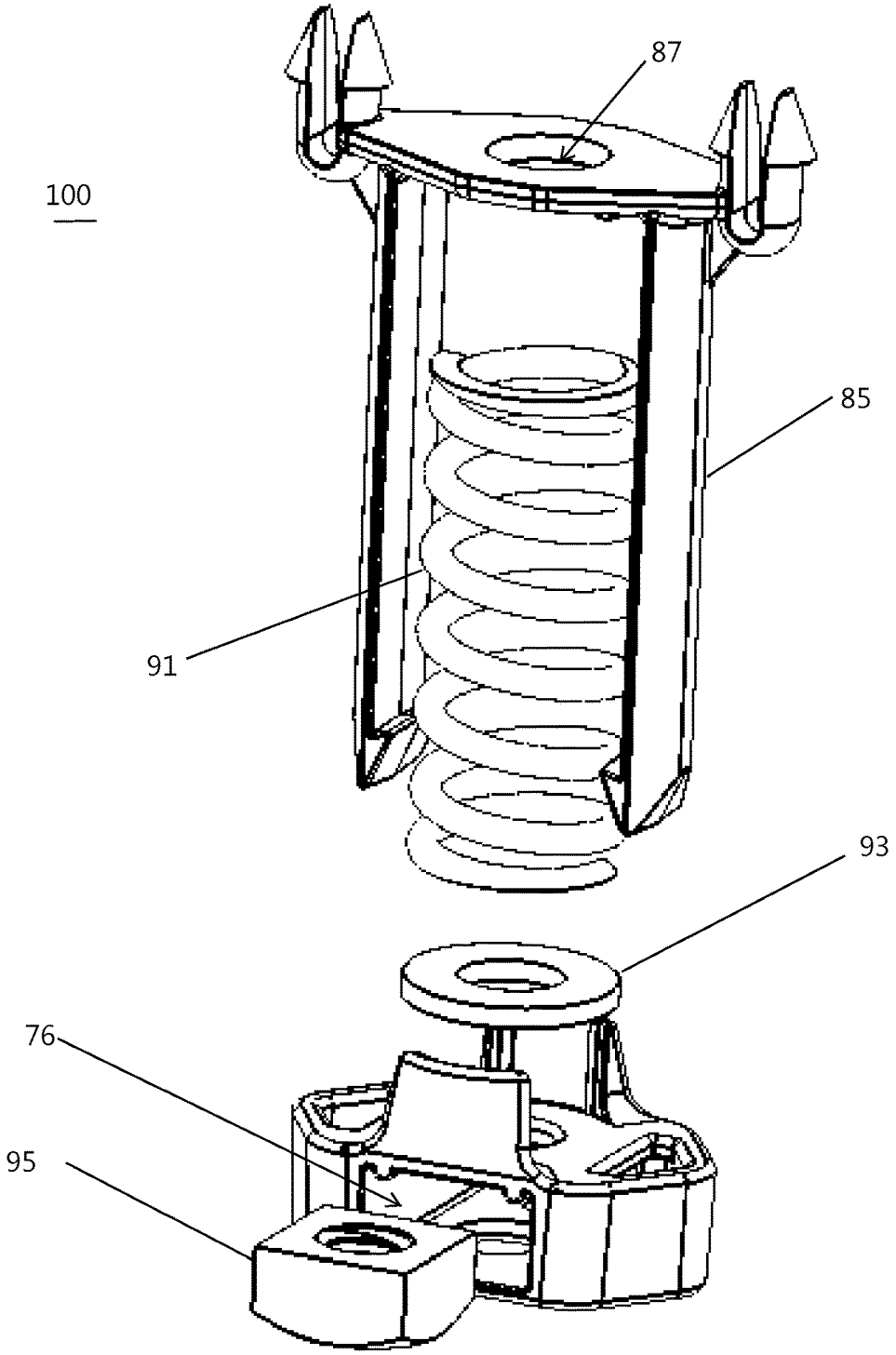
FIG. 10 is an exploded view of the individual components of a spring clip housing according to one embodiment.

To assemble spring clip housing 100, spring 91, plunger 70, spring retainer 80, and if desired, spring centering washer 93, are positioned relative to each other shown in FIG. 10. Subsequently, spring retainer 80 is moved relative to the plunger 70 to insert the catches 86 of arms 85 into the respective catch openings 73 of the plunger 70. The engagement of the catches 86 with the respective lower surface of the bearing surface 72 defining catch openings 73 captures and compresses spring 91 between spring retainer 80 and plunger 70 such that openings 71 and 87 are generally aligned and concentric with each other and the interior of spring 91. The threaded nut 95 is then positioned within the nut pocket 76 such that the threaded opening of nut 95 is generally aligned with and concentric with openings 71 and 87 and the interior of spring 93.

To assemble centering assembly 200, the spring clip housing 100 is attached to the centering bar 60 via the engagement between the centering bar engagement element (s) of the spring retainer 90 and the corresponding spring retainer engagement structure(s) of the centering bar 60, such as, e.g. the engagement of barbed hooks 83 with openings 63. Alternatively, it is to be understood that in other embodiments, the various components forming centering assembly 200 may be attached and assembled in any number of desired orders.

Figure 11:
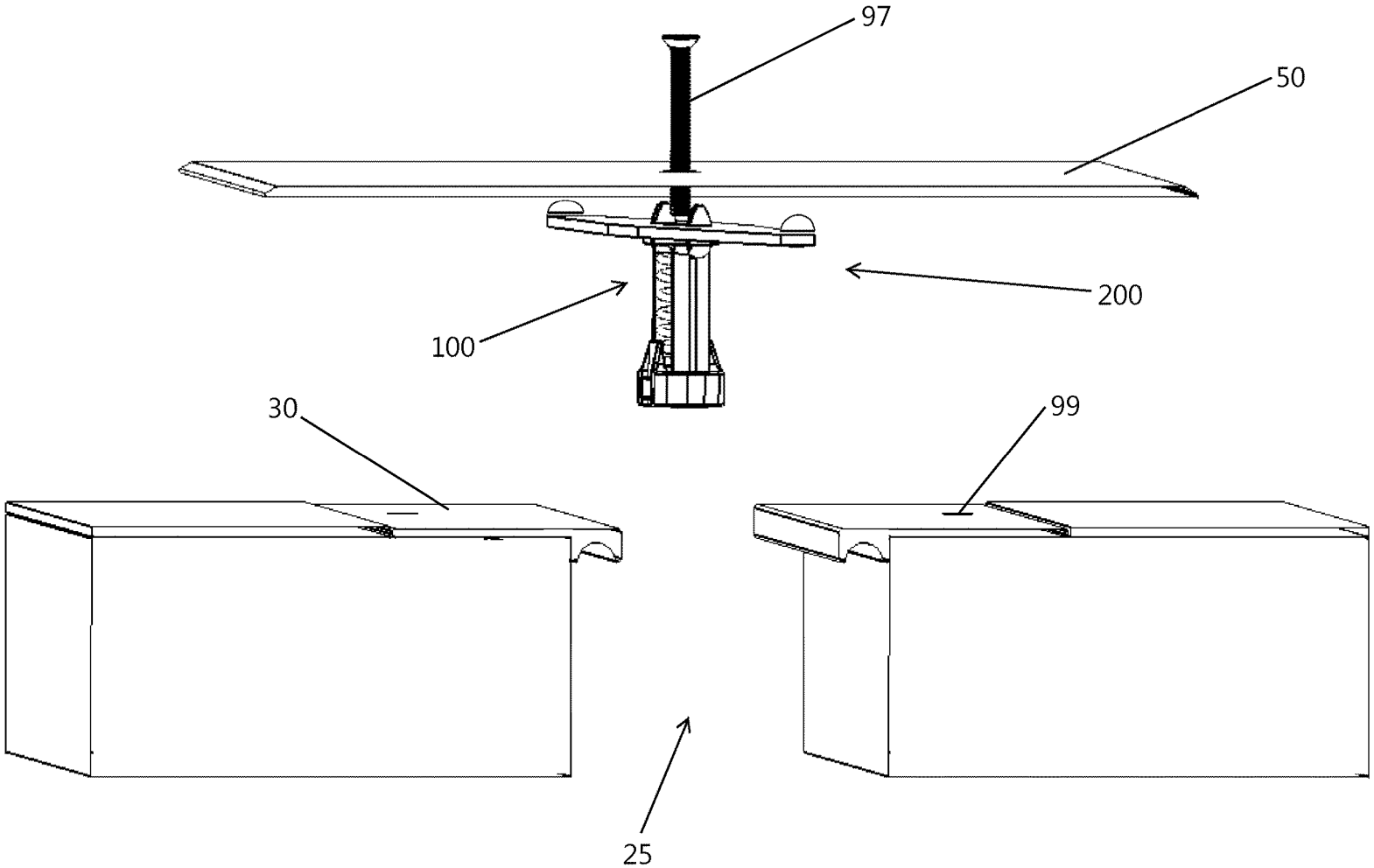
FIG. 11 is a perspective view of the components of an expansion joint assembly being installed into a joint space according to one embodiment.

As illustrated in FIG. 11, when the support plates 30 of the expansion joint assembly 10 are in place and installed along the structures 20 defining the joint space 25, the threaded free end of pull rod 97 is inserted through: the opening 55 of cover plate 50, the rod opening 65 of the centering bar 60, the opening 87 of the spring retainer 80, the spring 91, the washer 93 (if included) and the opening 71 in plunger 70 and into an initial threaded engagement with the nut 95 to initially loosely attach the centering assembly 200 to the cover plate 50. Once attached, the centering assembly 200/cover plate 50 assembly is lower into the joint space 25, with the centering bars 60 being arranged generally lengthwise relative to the joint space 25 so as to fit within the joint space 25, given that the overall width of the centering bars 60 is greater than the width of the joint space 25.

Once the centering bars 60 have initially been positioned within the joint space 27 and the guide elements 61 of the centering bars 60 have been located vertically below the channels 37 of the support plates 30, the threaded engagement between pull rod 97 and nut 95 is tightened, thereby bringing the centering assembly 200 and cover plate 50 into a final configuration. In particular, as the pull rod 97 is screwed into the nut 95, the centering bars 60 will rotate from their initially lengthwise orientation within the joint space 25 and towards an angled position, shown in e.g. FIG. 1B, in which the guide elements 61 are slidably positioned within the channels 37 of support plates 30, and the lower surface of the cover plate 50 is brought into engagement with the upper surfaces of the support plates 30, or in embodiments incorporating wing plates 40, the upper surfaces of wing plates 40. The pull rod 97 is tightened until a desired compressive force is applied to the spring 91 by the plunger 70 and spring retainer 80, with the compressive force being adjusted by varying the distance between plunger 70 and retainer 80. In some embodiments, the degree to which the spring 91 is compressed between the plunger and spring retainer 80 may be chosen so as to limit the vertical stresses on the centering bar 60 and/or cover plate 50.

In some embodiments, pull rod 97 may include a Philips or Allen chamfered head (or other appropriate engagement standard) that rests within the chamfered opening 55 in cover plate 50. By way of example, in some embodiments spring 91 may be made of a hardened stainless steel, plunger 70 and spring retainer 80 may be injection molded from an appropriate plastic, nut 95 may be a zinc plated nut, and washer 93 may be a zinc plated washer. Additionally, in some embodiments, support plates 30 and centering bars 60 may be fabricated from appropriate sheet steel and, depending upon the application, stainless steel.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. An expansion joint cover plate assembly for covering a gap between first and second sections of a wall, floor or ceiling of a building, the assembly comprising:

a first support plate attachable to a first section, the first support plate having a first support surface and a first engagement surface opposed to the first support surface;

a second support plate attachable to a second section, the second support plate having a second support surface and a second engagement surface opposed to the second support surface;

a cover plate extending between and supportable by the first and second support surfaces;

at least one centering bar defining a rod opening and having a first end engageable with the first engagement surface and a second end engageable with the second engagement surface;

an end assembly defining a first center opening, the end assembly including at least 2 translation rods each joined to the end assembly at one end and having a one-way catch at an opposite end;

a spring plunger defining a second center opening, the plunger including a first catch opening on one side of the second center opening and a second catch opening on an opposite side of the second center opening;

a spring compressed between the end assembly and the spring plunger such that an end portion of each translation rod is located within a respective one of the catch openings, and the one-way catches engaging the respective catch openings such that the spring retains a minimum compression between the end assembly and spring plunger, the spring being further compressible when the translation rods move within the catch openings to permit a reduction in the distance between the end assembly and the spring plunger; and a pull rod engageable with the cover plate and the spring plunger to extend through the rod opening, the first center opening, the spring, and the second center opening such that the spring biases the cover plate against the first and second support surfaces and biases the first and second ends of the centering bar against the respective first and second engagement surfaces.

2. The assembly of claim 1, wherein the center bar includes 2 mounting openings and the end assembly includes respective engagement features for engaging to the respective openings to position the rod opening concentric with the first center opening.

3. The assembly of claim 2, further comprising a threaded nut and one end of the pull rod is threaded and engageable with the threaded nut to force the spring plunger against the spring, wherein the spring is compressed at a force defined by the extent of engagement between the nut and the pull rod.

4. The assembly of claim 3, wherein the spring is a stainless steel spring.

5. The assembly of claim 4, wherein the spring plunger is molded from plastic.

6. The assembly of claim 5, wherein the end assembly is molded from plastic.

7. The assembly of claim 6, wherein the centering bar is an elongated flat bar fabricated from steel wherein the rod opening is at the center of the bar and the mounting openings are equally spaced from the rod center opening.

8. The assembly of claim 7, wherein the centering bar further comprises a point load formation at the end of each bar wherein the point load formations are the points at which the centering bar is engageable with the respective first and second engagement surfaces.

9. An expansion joint cover plate assembly covering a gap between first and second sections of a building floor, the assembly comprising:

a first support plate attached to the first section of the floor, the first support plate having a first support surface and a first engagement surface opposed to the first support surface;

a second support plate attached to the second section of the floor, the second support plate having a second support surface and a second engagement surface opposed to the second support surface;

at least one centering bar defining a rod opening and having a first end slidably engaged with the first engagement surface and a second end slidably engaged with the second engagement surface;

a cover plate extending between and slidably supported by the first and second support surfaces;

an end assembly defining a first center opening, the end assembly including at least two translation rods each joined to the end assembly at one end and having a one-way catch at an opposite end;

a spring plunger defining a second center opening, the plunger including a first catch opening on one side of the second center opening and a second catch opening on an opposite side of the second center opening;

a spring compressed between the end assembly and the spring plunger such that an end portion of each translation rod is located within a respective one of the catch openings, and the one-way catches engage the respective catch openings such that the spring is compressed between the end assembly and spring plunger with the spring further compressible when the translation rods move within the catch openings to permit a reduction in the distance between the end assembly and the spring plunger; and a pull rod attached to the cover plate, engaging the spring plunger and extending through the rod opening, the first center opening, the spring, and the second center opening such that the spring is compressed to bias the cover plate against the first and second support surfaces and biases the first and second ends of the centering bar against the respective first and second engagement surfaces.

10. The assembly of claim 9, wherein the center bar includes two mounting openings and the end assembly includes respective engagement engaged with the respective openings to position the rod opening concentric with the first center opening.

11. The assembly of claim 10, further comprising a threaded nut and one end of the pull rod is threaded and engaged with the threaded nut to force the spring plunger against the spring, wherein the spring is compressed at a force defined by the extent of engagement between the nut and the pull rod.

12. The assembly of claim 11, wherein the spring is a stainless steel spring.

13. The assembly of claim 12, wherein the end assembly and spring plunger are molded from plastic.

14. The assembly of claim 13, wherein the centering bar is an elongated flat bar fabricated from steel wherein the rod opening is at the center of the bar and the mounting openings are equally spaced from the rod center opening.

15. The assembly of claim 14, wherein the centering bar further comprises a point load formation at the end of each bar wherein the point load formations are the points at which the centering bar is engaged with the respective first and second engagement surfaces.

16. An expansion joint cover plate assembly for covering a gap between first and second sections of a wall, floor or ceiling of a building, the assembly comprising:

a first support plate attachable to a first section, the first support plate having a first support surface and a first engagement surface opposed to the first support surface;

a second support plate attachable to a second section, the second support plate having a second support surface and a second engagement surface opposed to the second support surface;

a cover plate extending between and supportable by the first and second support surfaces;

a first wing plate attachable to and supportable by the first support surface;

a second wing plate attachable to and supportable by the second support surface;

at least one centering bar defining a rod opening and having a first end engageable with the first engagement surface and a second end engageable with the second engagement surface;

a spring;

a pull rod fixed at a first end to the cover plate and extendable from the cover plate through the rod opening and through the spring;

an end assembly engageable to a second end of the rod to compress the spring between the end assembly and the centering bar such that the cover plate is forced against and held in contact with the wing plates;

the end assembly defining a first center opening, the end assembly including at least 2 translation rods each joined to the end assembly at one end and having a one-way catch at an opposite end; and a spring plunger defining a second center opening, the plunger including a first catch opening on one side of the second center opening and a second catch opening on an opposite side of the second center opening;

wherein the pull rod is extendable through the first and second center openings such that the spring is compressed between the end assembly and the spring plunger such that an end portion of each translation rod is located within a respective one of the catch openings, and the one-way catches engaging the respective catch openings such that the spring retains a minimum compression between the end assembly and spring plunger, the spring being further compressible when the translation rods move within the catch openings to permit a reduction in the distance between the end assembly and the spring plunger.

17. The assembly of claim 16, wherein a center bar includes two mounting openings and the end assembly includes respective engagement features for engaging to the respective openings to position the rod opening concentric with the first center opening.

18. The assembly of claim 17, further comprising a threaded nut and one end of the pull rod is threaded and engageable with the threaded nut to force the spring plunger against the spring, wherein the spring is compressed at a force defined by the extent of engagement between the nut and the pull rod.

19. The assembly of claim 18, further comprising a third support plate attachable to the first section proximate to the first plate support, the third support plate having a third support surface;

a fourth support plate attachable to the second section proximate to the second plate support, the fourth support plate having a fourth support surface;

the first wing plate attachable to and supportable by the third support surface; and the second wing plate attachable to and supportable by the second support surface.

* * * * *